US010980102B2

(12) United States Patent
Higa

(10) Patent No.: US 10,980,102 B2
(45) Date of Patent: Apr. 13, 2021

(54) HIGH-FREQUENCY COUPLER

(71) Applicant: MITSUBISHI HEAVY INDUSTRIES MACHINERY SYSTEMS, LTD., Hyogo (JP)

(72) Inventor: Kyusaku Higa, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 1 day.

(21) Appl. No.: 16/605,509

(22) PCT Filed: Mar. 22, 2018

(86) PCT No.: PCT/JP2018/011434
§ 371 (c)(1),
(2) Date: Oct. 16, 2019

(87) PCT Pub. No.: WO2018/193786
PCT Pub. Date: Oct. 25, 2018

(65) Prior Publication Data

US 2020/0127355 A1 Apr. 23, 2020

(30) Foreign Application Priority Data

Apr. 21, 2017 (JP) ..... JP2017-084631

(51) Int. Cl.
*H05H 7/02* (2006.01)
*H01P 5/02* (2006.01)
(Continued)

(52) U.S. Cl.
CPC ..... *H05H 7/02* (2013.01); *H01P 1/30* (2013.01); *H01P 3/06* (2013.01); *H01P 5/02* (2013.01);
(Continued)

(58) Field of Classification Search
CPC .... H01P 1/30; H01P 3/06; H01P 5/024; H01P 5/08; H01P 5/02; H05H 7/18; H05H 7/22;
(Continued)

(56) References Cited

U.S. PATENT DOCUMENTS

2008/0164421 A1* 7/2008 Tanaka ..... H05H 7/22 250/396 R
2019/0008028 A1* 1/2019 Okihira ..... H01P 1/08

FOREIGN PATENT DOCUMENTS

JP H05129098 5/1993

* cited by examiner

*Primary Examiner* — Robert J Pascal
*Assistant Examiner* — Jorge L Salazar, Jr.
(74) *Attorney, Agent, or Firm* — Hauptman Ham, LLP

(57) ABSTRACT

A radio frequency coupler includes a waveguide having an outer conductor and an inner conductor in a coaxial tube shape. The waveguide extends linearly from a power supply side, is bent in an L shape at a bend section, and extends linearly toward an acceleration cavity. A refrigerant passage part passes through the outer conductor and the inner conductor at the bend section from the outside of the waveguide toward the acceleration cavity and is connected to the interior of the inner conductor. The refrigerant passage part has a passage tube through which refrigerant passes between the inner part of the tip on the acceleration cavity side of the inner conductor, and the outer part of the waveguide, and the portion of the passage tube that is exposed to a radio frequency transmission space formed between the outer conductor and the inner conductor being formed of an insulator.

5 Claims, 5 Drawing Sheets

(51) Int. Cl.

| | |
|---|---|
| ***H01P 1/30*** | (2006.01) |
| ***H01P 3/06*** | (2006.01) |
| ***H01P 5/08*** | (2006.01) |
| ***H05H 7/18*** | (2006.01) |

(52) U.S. Cl.
CPC ..... *H01P 5/024* (2013.01); *H01P 5/08* (2013.01); *H05H 7/18* (2013.01)

(58) Field of Classification Search
CPC ..... H05H 2007/025; H05H 2007/227; H05H 7/02
USPC ..... 333/236, 243, 245
See application file for complete search history.

HIGH-FREQUENCY COUPLER

RELATED APPLICATIONS

The present application is a National Phase of International Application Number PCT/JP2018/011434 filed Mar. 22, 2018 and claims priority to Japanese Application Number 2017-084631 filed Apr. 21, 2017.

TECHNICAL FIELD

The present invention relates to a radio frequency coupler.

BACKGROUND ART

A radio frequency coupler is known as a radio frequency input device for inputting a high frequency into an acceleration cavity or the like of an accelerator. The radio frequency coupler has, for example, a coaxial tubular structure having an outer conductor and an inner conductor. In such a radio frequency coupler, when a high frequency is input to the acceleration cavity, a tip portion of the inner conductor on the acceleration cavity side generates heat. For this reason, for example, a passage tube made of metal is inserted into the inner conductor from the outside of a waveguide and cooling is performed by causing a refrigerant to flow through the passage tube (refer to, for example, PTL 1).

CITATION LIST

Patent Literature

[PTL 1] Japanese Unexamined Patent Application Publication No. 5-129098

SUMMARY OF INVENTION

Technical Problem

In the radio frequency coupler described above, a T-shaped waveguide is used in order to prevent the passage tube made of metal from crossing a radio frequency transmission space between the outer conductor and the inner conductor. Specifically, a configuration is made in which the outer conductor and the inner conductor protrude to the side opposite to the acceleration cavity side and the inner conductor protrudes to the outside of the waveguide through an end portion in a protruding direction of the outer conductor. In this case, a configuration is made in which the passage tube does not cross the radio frequency transmission space by directly inserting the passage tube into the inner conductor from the protruding portion of the inner conductor. However, in this configuration, a space for the protruding portion which protrudes to the side opposite to the acceleration cavity is required.

The present invention has been made in view of the above and has an object to provide a radio frequency coupler in which it is possible to achieve space-saving.

Solution to Problem

An aspect of the present invention, there is provided a radio frequency coupler including: a waveguide having an outer conductor and an inner conductor provided in a coaxial tube shape, the waveguide linearly extending from a power supply side, being bent in an L shape at a bend section, and linearly extending toward an acceleration cavity side; and a refrigerant passage part which penetrates the outer conductor and the inner conductor from an outside of the waveguide toward the acceleration cavity side at the bend section and is connected to an interior of the inner conductor, the refrigerant passage part having a passage tube which causes a refrigerant to flow between an interior of a tip portion of the inner conductor on the acceleration cavity side and the outside of the waveguide, and a portion of the passage tube, which is exposed to a radio frequency transmission space which is formed between the outer conductor and the inner conductor, being formed of an insulator.

According to the aspect of the present invention, the portion which is exposed to the radio frequency transmission space which is formed between the outer conductor and the inner conductor in the passage tube of the refrigerant passage part is formed of an insulator, and therefore, a configuration in which an electric conductor crosses the radio frequency transmission space can be avoided. In this way, since the waveguide does not need to be branched to the side opposite to the acceleration cavity and can be formed in an L shape toward the acceleration cavity side at the bend section, space-saving can be achieved.

Further, the waveguide may have an adjustment part which adjusts electrical characteristics of at least one of the outer conductor and the inner conductor.

According to the aspect of the present invention, the electrical characteristics of the waveguide are adjusted by the adjustment part, and therefore, it is possible to alleviate the influence in a case where the insulator which is disposed in the radio frequency transmission space becomes a dielectric.

Further, the passage tube may have a first tube part which is formed of an insulator and connects the outside of the waveguide and the interior of the inner conductor, and a second tube part which is formed of metal, disposed in the interior of the inner conductor, connected to the first tube part in the interior of the inner conductor, and extends to the interior of the tip portion of the inner conductor.

According to the aspect of the present invention, the passage tube is formed by connecting the first tube part that is an insulator which is disposed at the portion crossing the radio frequency transmission space and the second tube part that is made of a high rigidity metal which is disposed in the interior of the inner conductor, whereby it is possible to reduce a work load when installing the passage tube on the inner conductor, and it becomes possible to easily realize a configuration in which an electric conductor does not cross the radio frequency transmission space.

Further, the whole of the passage tube may be formed of an insulator.

According to the aspect of the present invention, the whole of the passage tube is formed of an insulator, and therefore, a configuration in which an electric conductor does not cross the radio frequency transmission space can be easily realized.

Further, the passage tube may have at least a main body portion which is disposed in an interior of the waveguide and formed of metal, and a covering portion which is formed of an insulator and covers a portion of the main body portion, which is exposed to the radio frequency transmission space.

According to the aspect of the present invention, the main body portion of the passage tube is formed of metal, whereby it is possible to reduce a work load when installing the passage tube. Further, the portion which is exposed to the radio frequency transmission space is covered with the covering portion, whereby a configuration in which an electric conductor does not cross the radio frequency transmission space can be easily realized.

Advantageous Effects of Invention

According to the present invention, it is possible to provide a radio frequency coupler in which it is possible to achieve space-saving.

DESCRIPTION OF EMBODIMENTS

Hereinafter, an embodiment of a radio frequency coupler according to the present invention will be described based on the drawings. The present invention is not limited by this embodiment. Further, in constituent elements in the following embodiment, elements capable of being easily replaced by those skilled in the art or elements that are substantially the same as the constituent elements are included.

Figure 1:
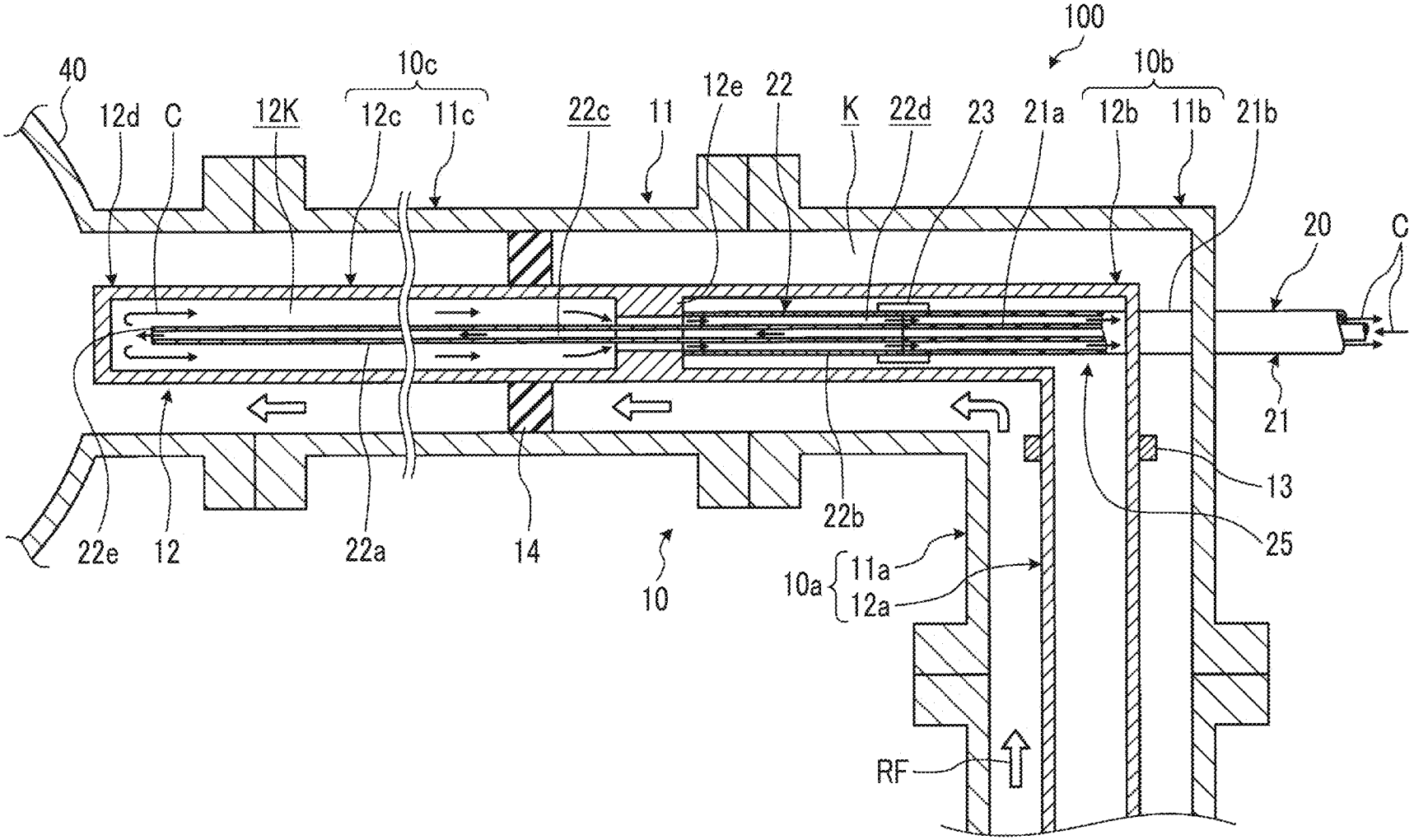
FIG. 1 is a sectional view showing an example of a radio frequency coupler according to the present embodiment.

FIG. 1 is a sectional view showing an example of a radio frequency coupler 100 according to this embodiment. As shown in FIG. 1, the radio frequency coupler 100 is used as a radio frequency input device for inputting a high frequency to an acceleration cavity 40 of an accelerator. The radio frequency coupler 100 includes a waveguide 10 and a refrigerant passage part 20.

The waveguide 10 transmits a radio frequency power from a power supply to the acceleration cavity 40. The waveguide 10 has a first straight section 10*a*, a bend section 10*b*, and a second straight section 10*c*. The first straight section 10*a* is connected to, for example, the power supply side. The bend section 10*b* is formed in an L shape and connects the first straight section 10*a* and the second straight section 10*c*. The second straight section 10*c* linearly extends from the bend section 10*b* toward the acceleration cavity 40.

The waveguide 10 has a coaxial tubular structure having an outer conductor 11 and an inner conductor 12. The outer conductor 11 and the inner conductor 12 are formed using a conductor such as metal. The outer conductor 11 and the inner conductor 12 respectively have first straight sections 11*a* and 12*a*, bend sections 11*b* and 12*b*, and second straight sections 11*c* and 12*c* corresponding to the first straight section 10*a*, the bend section 10*b*, and the second straight section 10*c*. A radio frequency transmission space K is formed between the outer conductor 11 and the inner conductor 12. The radio frequency transmission space K is a radio frequency transmission path through which the radio frequency power is transmitted.

The waveguide 10 has an adjustment part 13. The adjustment part 13 adjusts the electrical characteristics of the waveguide 10 to reduce the influence of fluctuations in the electrical characteristics due to an insulator which will be described later. In this embodiment, the adjustment part 13 is, for example, a protrusion portion which protrudes from the outer surface of the inner conductor 12. However, there is no limitation thereto. The adjustment part 13 may be disposed at the outer conductor 11.

The waveguide 10 has a window part 14. The window part 14 is disposed in the radio frequency transmission space K. The window part 14 is formed using, for example, an insulator such as ceramics. Therefore, the window part allows passage of the radio frequency power. The window part 14 is formed, for example, in a ring shape and is sandwiched between the outer conductor 11 and the inner conductor 12. Due to the window part 14, the positional relationship between the outer conductor 11 and the inner conductor 12 is maintained while enabling the transmission of the radio frequency power.

The refrigerant passage part 20 allows passage of a refrigerant C for cooling a tip portion 12*d* of the inner conductor 12 on the acceleration cavity 40 side. In the radio frequency coupler 100, when the radio frequency power is input to the acceleration cavity 40, the tip portion 12*d* of the inner conductor 12 generates heat. For this reason, the tip portion 12*d* of the inner conductor 12 is cooled by disposing the refrigerant passage part 20.

The refrigerant passage part 20 has a passage tube and a refrigerant supply source (not shown). The passage tube 25 passes through the outer conductor 11 and the inner conductor 12 in a direction parallel to the second straight section 10*c* from the outside of the waveguide 10 toward the acceleration cavity 40 side at the bend section 10*b* and is connected to an interior 12K of the inner conductor 12. That is, the passage tube 25 is in a state of being inserted into the interior 12K of the inner conductor 12 from the outside of the waveguide 10.

The passage tube 25 has a first tube part 21, a second tube part 22, and a joint part 23. The first tube part 21 passes through the inner conductor 12 from the outside of the waveguide 10 and is disposed up to a position in the middle of the second straight section 12*c* in the interior 12K. Therefore, the first tube part 21 is disposed across the radio frequency transmission space K. The first tube part 21 is formed of, for example, an insulator such as ceramics (alumina ceramics or the like), plastic, or mica. As such an insulator, for example, a material having an electric resistance value of $1\times10^{12}$ [Ω·cm] or more is used.

The second tube part 22 is connected to the first tube part 21. The second tube part 22 is disposed to extend from an end portion of the first tube part 21 to the tip portion 12*d* of the inner conductor 12. Therefore, the whole of the second tube part 22 is disposed in the interior 12K of the inner conductor 12. The second tube part 22 is formed using metal such as stainless steel. Therefore, the second tube part 22 can be disposed in a state of having desired rigidity in the interior 12K of the inner conductor 12.

In the passage tube 25 described above, the first tube part 21 is disposed across the radio frequency transmission space K of the inner conductor 12, and the entire outer surface which is exposed to the radio frequency transmission space K is an insulator. On the other hand, the second tube part 22 which is formed of a conductor (metal) is not exposed to the radio frequency transmission space K. For this reason, the radio frequency transmission space K is in a state where the metal is not exposed, and can transmit the radio frequency power.

Figure 2:
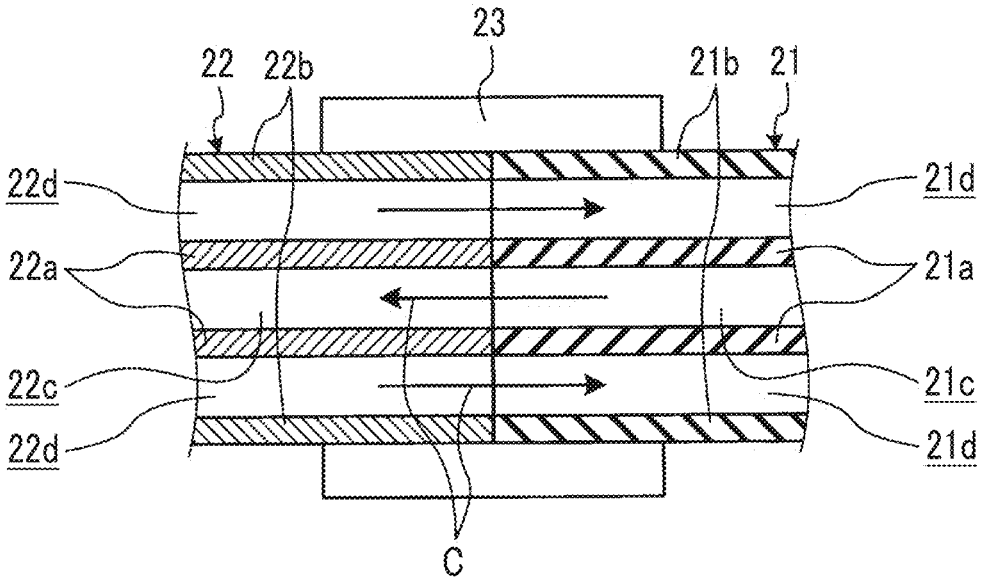
FIG. 2 is a sectional view showing an example of a connection portion between a first tube part and a second tube part.

FIG. 2 is a sectional view showing an example of a connection portion between the first tube part 21 and the second tube part 22. As shown in FIG. 2, the first tube part 21 and the second tube part 22 are connected to each other by the joint part 23. The first tube part 21 has a double tube structure. The first tube part 21 has an inner tube 21*a* and an outer tube 21*b*. The inner tube 21*a* is connected to a supply source of the refrigerant C. A flow path 21*c* is formed in the inner tube 21*a*. In the flow path 21*c*, the refrigerant C flows from the outside of the waveguide 10 toward the interior 12K of the inner conductor 12.

The outer tube 21*b* is provided to enclose the inner tube 21*a*. A flow path 21*d* is formed between the outer tube 21*b* and the inner tube 21*a*. In the flow path 21*d*, the refrigerant C returning from the second tube part 22 flows. A spacer or the like may be disposed at the outer tube 21*b* such that a space is reliably formed between the outer tube 21*b* and the inner tube 21*a*.

The second tube part 22 has a double tube structure at the connection portion with the first tube part 21. The second tube part 22 has an inner tube 22*a* and an outer tube 22*b*. The inner tube 22*a* is connected to the inner tube 21*a* of the first tube part 21 and is disposed up to the vicinity of the tip portion 12*d* of the inner conductor 12 by passing through a reduced diameter portion 12*e* which will be described later. The inner tube 22*a* has an end portion 22*e* which is disposed toward the tip portion 12*d*. The end portion 22*e* is open. A flow path 22*c* is formed in the inner tube 22*a*. In the flow path 22*c*, the refrigerant C from the flow path 21*c* of the first tube part 21 flows toward the tip portion 12*d* of the inner conductor 12.

The outer tube 22*b* is provided to enclose the inner tube 22*a*. A flow path 22*d* is formed between the outer tube 22*b* and the inner tube 22*a*. In the flow path 22*d*, the refrigerant C returning from the tip portion 12*d* of the inner conductor 12 flows. A spacer or the like may be disposed at the outer tube 22*b* such that a space is reliably formed between the outer tube 22*b* and the inner tube 22*a*. An end portion of the outer tube 22*b* on the acceleration cavity 40 side is connected to the reduced diameter portion 12*e* which protrudes to the inside of the inner conductor 12.

Figure 3:
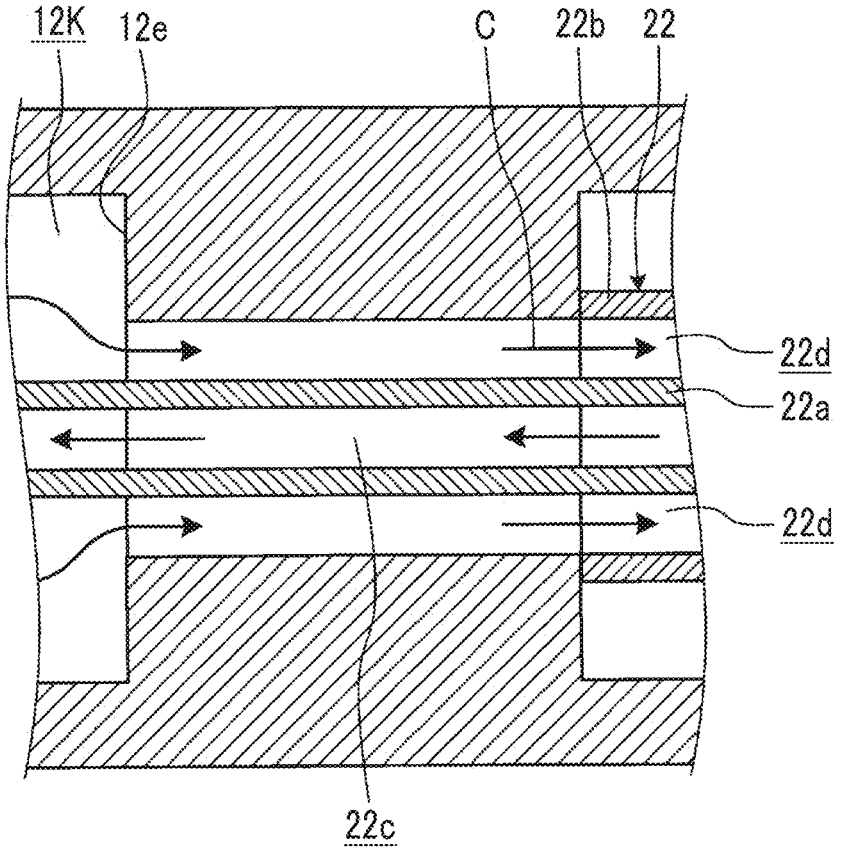
FIG. 3 is a diagram showing an example of a reduced diameter portion.

FIG. 3 is a diagram showing an example of the reduced diameter portion 12*e*. As shown in FIG. 3, the reduced diameter portion 12*e* reduce an inner diameter at a part of the inner conductor 12. The reduced diameter portion 12*e* is set such that an inner diameter thereof is larger than the inner tube 22*a* of the second tube part 22 and a sufficient space for the flow of the refrigerant C is secured between the reduced diameter portion 12*e* and the inner tube 22*a*. In this embodiment, the inner diameter of the reduced diameter portion 12*e* can be set to be substantially the same as the inner diameter of the outer tube 22*b*. However, there is no limitation thereto.

In the refrigerant passage part 20 described above, the refrigerant C flows through the flow path 21*c* of the inner tube 21*a* of the first tube part 21 from the outside of the waveguide 10 toward the acceleration cavity 40 side and flows into the flow path 22*c* of the inner tube 22*a* of the second tube part 22 at the joint part 23 in the interior 12K of the inner conductor 12. The refrigerant C flows through the flow path 22*c* toward the acceleration cavity 40 side and flows out from the end portion 22*e* of the second tube part 22 to the interior 12K of the inner conductor 12.

The refrigerant C flows toward the bend section 10*b* side with the interior 12K of the inner conductor 12 as a flow path, and flows into the flow path 22*d* through the reduced diameter portion 12*e*. The refrigerant C flows through the flow path 22*d* toward the bend section 10*b* side and flows into the flow path 21*d* of the outer tube 21*b* of the first tube part 21 at the joint part 23. Then, the refrigerant C further flows through the flow path 21*d* to the bend section 10*b* side and flows out to the outside of the waveguide 10. The flow path 21*d* may be provided with, for example, a circulation mechanism that releases the heat of the refrigerant C and then returns the refrigerant C to the flow path 21*c*.

As described above, the radio frequency coupler 100 according to this embodiment includes: the waveguide 10 having the outer conductor 11 and the inner conductor 12 provided in a coaxial tube shape, the waveguide linearly extending from the power supply side, being bent in an L shape at the bend section 10*b*, and linearly extending toward the acceleration cavity 40 side; and a refrigerant passage part 20 which passes through the outer conductor and the inner conductor 12 from the outside of the waveguide 10 toward the acceleration cavity 40 side at the bend section 10*b* and is connected to the interior 12K of the inner conductor 12, the refrigerant passage part 20 having a passage tube 25 which causes the refrigerant C to flow between the interior of the tip portion 12*d* of the inner conductor 12 and the outside of the waveguide 10, and a portion of the passage tube 25, which is exposed to the radio frequency transmission space K, being formed of an insulator.

In this configuration, by disposing the passage tube from the outside of the waveguide 10 toward the interior 12K of the inner conductor 12 and causing the refrigerant C to flow through the passage tube 25, it becomes possible to cool the tip portion 12*d* of the inner conductor 12. Further, the portion of the passage tube 25, which is exposed to the radio frequency transmission space K which is formed between the outer conductor 11 and the inner conductor 12, is formed of an insulator, and therefore, a configuration in which an electric conductor crosses the radio frequency transmission space K can be avoided. In this way, the waveguide 10 does not need to be branched to the side opposite to the acceleration cavity 40 and can be formed in an L shape toward the acceleration cavity 40 side at the bend section 10*b*, and therefore, space-saving can be achieved.

Further, in the radio frequency coupler 100 according to this embodiment, the passage tube 25 is formed by connecting the first tube part 21 that is an insulator which is disposed at a portion crossing the radio frequency transmission space K and the second tube part 22 that is made of a high rigidity metal which is disposed in the interior 12K of the inner conductor 12, whereby it is possible to reduce a work load when installing the passage tube 25 on the inner conductor 12, and it becomes possible to easily realize a configuration in which an electric conductor does not cross the radio frequency transmission space K.

The technical scope of the present invention is not limited to the embodiment described above, and changes can be appropriately made within a scope which does not depart from the gist of the present invention. For example, in the embodiment described above, the configuration in which the passage tube 25 is formed by connecting the first tube part 21 that is an insulator which is disposed at a portion crossing the radio frequency transmission space K and the second tube part 22 that is made of a high rigidity metal which is disposed in the interior 12K of the inner conductor 12 has been described as an example. However, there is no limitation thereto.

Figure 4:
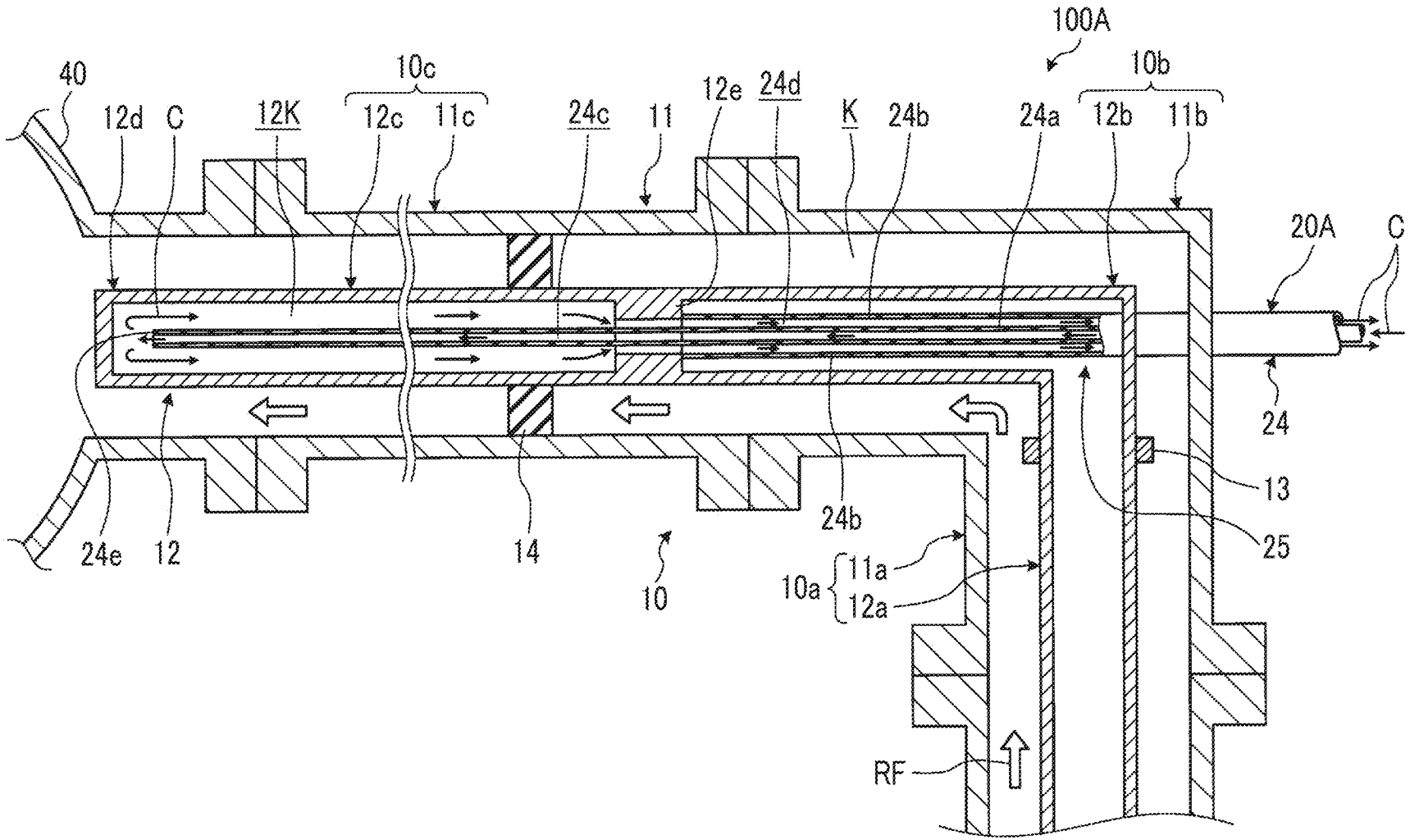
FIG. 4 is a sectional view showing an example of a radio frequency coupler according to a modification example.

FIG. 4 is a sectional view showing an example of a radio frequency coupler 100A according to a modification example. In the radio frequency coupler 100A shown in FIG. 4, the whole of a passage tube 24 of a refrigerant passage part 20A is formed of an insulator. The passage tube 24 has a double tube structure. The passage tube 24 has an inner tube 24*a* and an outer tube 24*b*. The inner tube 24*a* is connected to the supply source of the refrigerant C and is disposed up to the vicinity of the tip portion 12*d* of the inner conductor 12 by passing through the reduced diameter portion 12*e*. The inner tube 24*a* has an end portion 24*e* which is disposed toward the tip portion 12*d*. The end portion 24*e* is open. A flow path 24*c* is formed in the inner tube 24*a*. In the flow path 24*c*, the refrigerant C flows from the supply source to the end portion 24*e*. The outer tube 24*b* is provided to enclose the inner tube 24*a*. An end portion of the outer tube 22*b* on the acceleration cavity 40 side is connected to the reduced diameter portion 12*e* that protrudes to the inside of the inner conductor 12. A flow path 24*d* is formed between the outer tube 24*b* and the inner tube 24*a*. In the flow path 24*d*, the refrigerant C returning from the tip portion 12*d* of the inner conductor 12 through the reduced diameter portion 12*e* flows.

The outer tube 22*b* is provided to enclose the inner tube 22*a*. A flow path 22*d* is formed between the outer tube 22*b* and the inner tube 22*a*. In the flow path 22*d*, the refrigerant C returning from the tip portion 12*d* of the inner conductor 12 flows. A spacer or the like may be disposed at the outer tube 22*b* such that a space is reliably formed between the outer tube 22*b* and the inner tube 22*a*.

According to this configuration, by disposing the passage tube 24 from the outside of the waveguide 10 toward the interior of the inner conductor 12 and causing the refrigerant C to flow through the passage tube 24, it becomes possible to cool the tip portion 12*d* of the inner conductor 12. Further, the whole of the passage tube 24 is formed of an insulator, and therefore, a configuration in which an electric conductor does not cross the radio frequency transmission space K can be easily realized.

Figure 5:
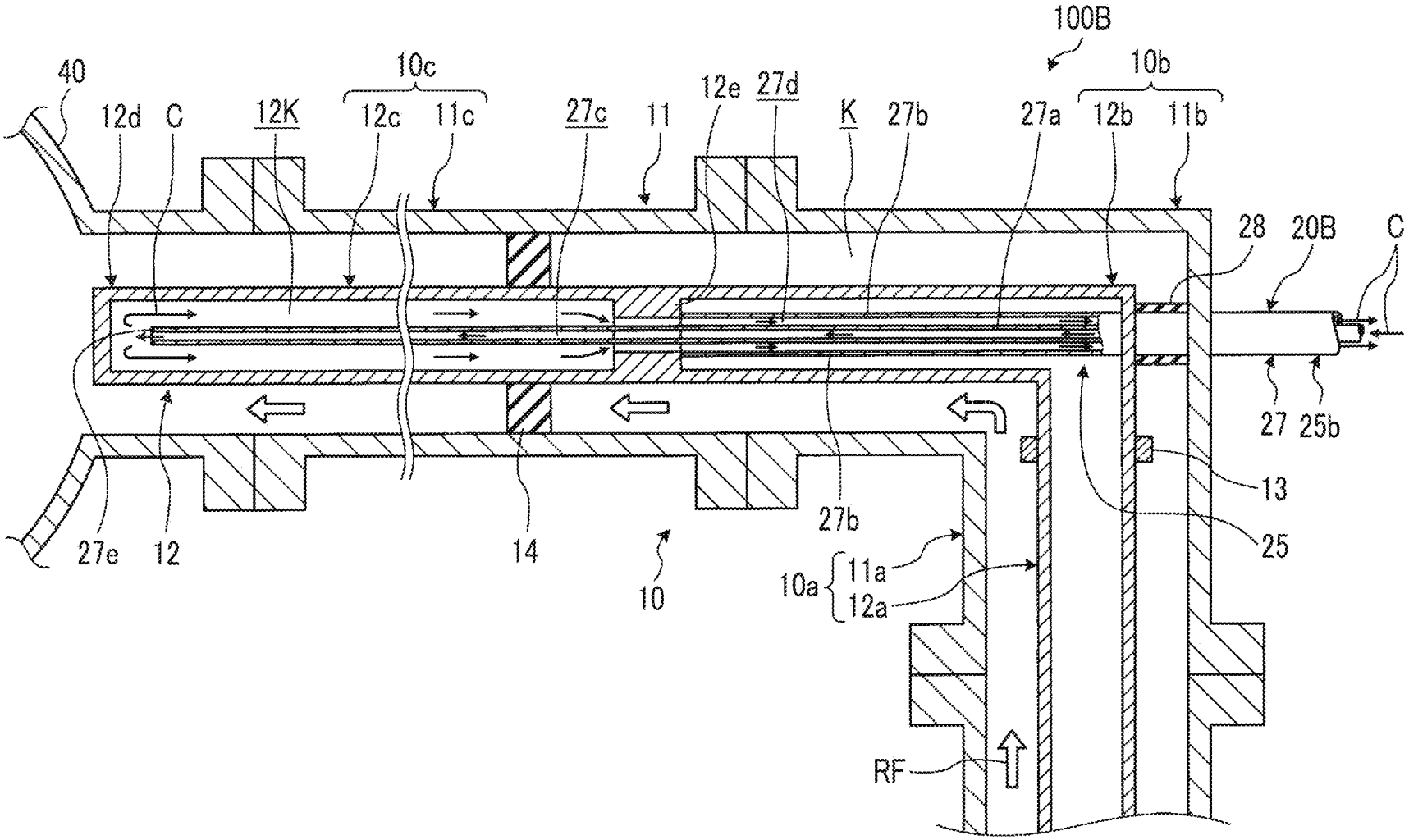
FIG. 5 is a sectional view showing an example of a radio frequency coupler according to a modification example.

FIG. 5 is a sectional view showing an example of a radio frequency coupler 100B according to a modification example. In the radio frequency coupler 100B shown in FIG. 5, a passage tube 25B of a refrigerant passage part 20B has a main body portion 27 and a covering portion 28. The whole of the main body portion 27 is formed of metal. The main body portion 27 has a double tube structure. The main body portion 27 has an inner tube 27*a* and an outer tube 27*b*. The configurations of the inner tube 27*a* and the outer tube 27*b* can be the same as those of the inner tube 24*a* and the outer tube 24*b* shown in FIG. 4 except for the material thereof.

The covering portion 28 is formed of an insulator and covers the portion of the main body portion 27, which is exposed to the radio frequency transmission space K. According to this configuration, the main body portion 27 of the passage tube 25B is formed of metal, whereby it is possible to reduce a work load when installing the passage tube 25B. Further, the portion which is exposed to the radio frequency transmission space K is covered with the covering portion 28, whereby a configuration in which an electric conductor does not cross the radio frequency transmission space K can be easily realized.

Figure 6:
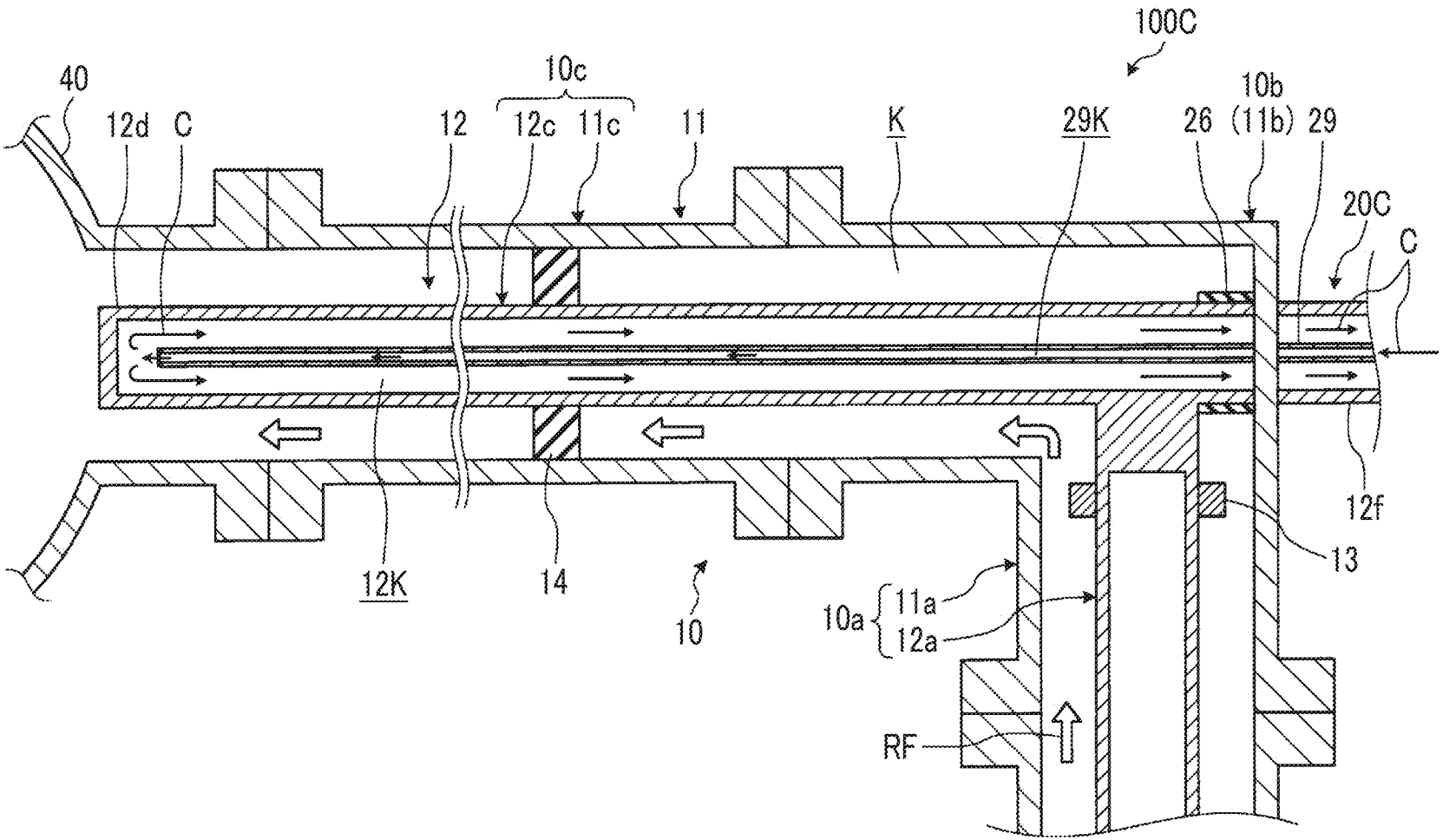
FIG. 6 is a sectional view showing an example of a radio frequency coupler according to a modification example.

Further, in the embodiment described above, the configurations are made in which the passage tubes 24, 25, and 25B are inserted from the outside. However, there is no limitation thereto. FIG. 6 is a sectional view showing an example of a radio frequency coupler 100C according to a modification example. In the radio frequency coupler 100C shown in FIG. 6, a branch portion 12*f* of the inner conductor 12 linearly extends toward the bend section 10*b* side and passes through the outer conductor 11 to protrude to the outside of the waveguide 10.

In FIG. 6, a refrigerant passage part 20C has a passage tube 29 disposed in the interior 12K of the inner conductor 12. A flow path 29K is formed in the passage tube 29. The refrigerant C flows through the flow path 29K to flow to the tip portion 12*d* of the inner conductor 12. Further, the refrigerant C is returned from the tip portion 12*d* to the outside of the waveguide 10 through the interior 12K of the inner conductor 12 and the branch portion 12*f*.

According to this configuration, the interior 12K of the inner conductor 12 can be effectively used as a flow path for the refrigerant C. Further, the outer surface of the portion of the branch portion 12*f* of the inner conductor 12, which is disposed in the radio frequency transmission space K, is covered with a covering portion 26 which is an insulator. In this way, a configuration in which an electric conductor does not cross the radio frequency transmission space K can be easily realized.

REFERENCE SIGNS LIST

10: waveguide
10*a*, 11*a*, 12*a*: first straight section
10*b*, 11*b*, 12*b*: bend section
10*c*, 11*c*, 12*c*: second straight section
11: outer conductor
12: inner conductor
12*d*: tip portion
12*e*: reduced diameter portion
12K: interior
13: adjustment part
14: window part
20, 20A, 20B, 20C: refrigerant passage part
21: first tube part
21*a*, 22*a*, 24*a*, 27*a*: inner tube
21*b*, 22*b*, 24*b*, 27*b*: outer tube
21*c*, 21*d*, 22*c*, 22*d*, 24*c*, 24*d*, 29K: flow path
22: second tube part
22*e*, 24*e*: end portion
23: joint part
24, 25, 25B, 29: passage tube
26, 28: covering portion
27: main body portion
40: acceleration cavity
100, 100A, 100B, 100C: radio frequency coupler
C: refrigerant
K: radio frequency transmission space
RF: high frequency

The invention claimed is:

1. A radio frequency coupler comprising:

a waveguide having an outer conductor and an inner conductor provided in a coaxial tube shape, the waveguide linearly extending from a power supply side, being bent in an L shape at a bend section, and linearly extending toward an acceleration cavity side; and a refrigerant passage part which penetrates the outer conductor and the inner conductor from an outside of the waveguide toward the acceleration cavity side at the bend section and is connected to an interior of the inner conductor, the refrigerant passage part having a passage tube which causes a refrigerant to flow between an interior of a tip portion of the inner conductor on the acceleration cavity side and the outside of the waveguide, and a portion of the passage tube, which is exposed to a radio frequency transmission space which is formed between the outer conductor and the inner conductor, being formed of an insulator.

2. The radio frequency coupler according to claim 1, wherein the waveguide has an adjustment part which adjusts electrical characteristics of at least one of the outer conductor and the inner conductor.

3. The radio frequency coupler according to claim 1, wherein the passage tube has a first tube part which is formed of an insulator and connects the outside of the waveguide and the interior of the inner conductor, and a second tube part which is formed of metal, disposed in the interior of the inner conductor, connected to the first tube part in the interior of the inner conductor, and extends to the interior of the tip portion of the inner conductor.

4. The radio frequency coupler according to claim 1, wherein the whole of the passage tube is formed of an insulator.

5. The radio frequency coupler according to claim 1, wherein the passage tube has at least a main body portion which is disposed in an interior of the waveguide and formed of metal, and a covering portion which is formed of an insulator and covers a portion of the main body portion, which is exposed to the radio frequency transmission space.

* * * * *